United States Patent [19]

Rasmussen

[11] 4,092,513

[45] May 30, 1978

[54] STIRRER HUB ASSEMBLY

[75] Inventor: Glenn O. Rasmussen, St. Paul, Minn.

[73] Assignee: Litton Systems, Inc., Beverly Hills, Calif.

[21] Appl. No.: 764,279

[22] Filed: Jan. 31, 1977

[51] Int. Cl.[2] ..... H05B 9/06

[52] U.S. Cl. ..... 219/10.55 F; 416/231 A; 416/DIG. 3

[58] Field of Search ..... 219/10.55 F, 10.55 R; 416/181, 231 A, 227 R, DIG. 3; 259/4 A, 7, 81 R, 125

[56] References Cited

U.S. PATENT DOCUMENTS

| | | | |
|---|---|---|---|
| 3,626,136 | 12/1971 | Funahashi | 219/10.55 F |
| 3,746,823 | 7/1973 | Whiteley | 219/10.55 F |
| 3,872,276 | 3/1975 | Corcoran et al. | 219/10.55 F |

FOREIGN PATENT DOCUMENTS

| | | | |
|---|---|---|---|
| 41,497 | 1/1969 | Japan | 219/10.55 F |

*Primary Examiner*—J. V. Truhe
*Assistant Examiner*—Bernard Roskoski
*Attorney, Agent, or Firm*—Robert E. Lowe

[57] ABSTRACT

The field stirrer herein has an upwardly concave pan shape and is formed as a sheet metal stamping. It has a central planar section and a surrounding section comprising a plurality of circumferentially arranged segments with planar surfaces, the segments being shaped like equilateral trapezoids. The surrounding section has three circumferentially spaced segment groups in which the individual segments thereof slope upwardly at an angle of approximately 45° relative to the planar section. Each of the segment groups includes at least three of the segments which are laterally joined by folded edges. There are also three individually mounted segments arranged alternately relative to the three segment groups which slope upwardly at an angle of approximately 27° relative to the central planar section. At least one segment in each segment group has a rectangularly shaped opening with a rectangularly shaped flap extending vertically downwardly from the upper edge of said opening. The stirrer includes a central hub member and at least one rectangularly shaped opening in the planar section spaced from the hub member and extending in a generally tangential direction relative thereto. A rectangularly shaped flap is at the inner edge of the opening and the flap is inclined towards the hub member to form an acute angle relative to said central planar section.

3 Claims, 6 Drawing Figures

STIRRER HUB ASSEMBLY

The invention relates to a new and improved field stirrer for microwave ovens.

In microwave ovens energy is transported by microwaves from the magnetron generator to the food to be heated which food is actually a part of the microwave circuit.

The walls of the oven reflect microwaves but the glass or ceramic dishware which holds the food is substantially lossless and thus are transparent to microwaves. The food itself has varying degrees of absorbtiveness and thus attenuate microwaves in varying degrees depending on the absorbtive index of the food. The reflective property of the metal walls provide for multiple passes of attenuated waves through the food until all of the energy has been extracted from the waves. That is, the waves attenuate because they are partially absorbed in their transmission through the food and, upon impinging on the metal cavity walls, they reflect again and again until all of the energy is used up in the heating process.

It is a desired object to have a uniform distribution of energy in the cavity heating space so that all parts of the load, or food, will receive heat in an equal manner. An inherent problem in achieving this goal, however, is that the food is the load part of the microwave circuit and is subject to wide variation as to size, shape, weight and material identity. A further variation is that as the heating proceeds the change in the moisture content of the food changes the load characteristics of the food in the microwave circuit.

Without the utilization of a field stirrer each condition in a range of load variations represents a particular microwave energy distribution mode.

For each of the many variable load conditions there is thus a more or less randomly formed microwave energy distribution mode which is represented by a nonuniform standing wave pattern. An uneven energy distribution pattern of course means that there is an undesirable unevenness in the cooking heat applied to the food.

Field stirrers are used to improve the distribution of the microwave energy in the cavity by causing a relatively slow-speed time variation in the standing wave pattern within the cavity. The variable load conditions cause such complex energy distribution modes that the design of field stirrers is a largely empirical cut and try proposition to achieve the best results.

The new and improved field stirrer which is the subject of this invention has particular reflecting blade characteristics which tests have shown improve the energy distribution pattern in the oven. An added feature is that the blade configuration causes a reduction in the microwave energy concentration in the vicinity of the oven door and this is advantageous in that it lessens the difficulty of providing effective microwave energy sealing means for the door.

The main object of the invention is to provide a new and improved field stirrer which improves the energy distribution pattern in the oven and which reduces the concentration of microwave energy in the viscinity of the oven door.

Other objects and advantages of the invention will become apparent from the following specification, drawings and appended claims.

IN THE DRAWINGS

Figure 1:
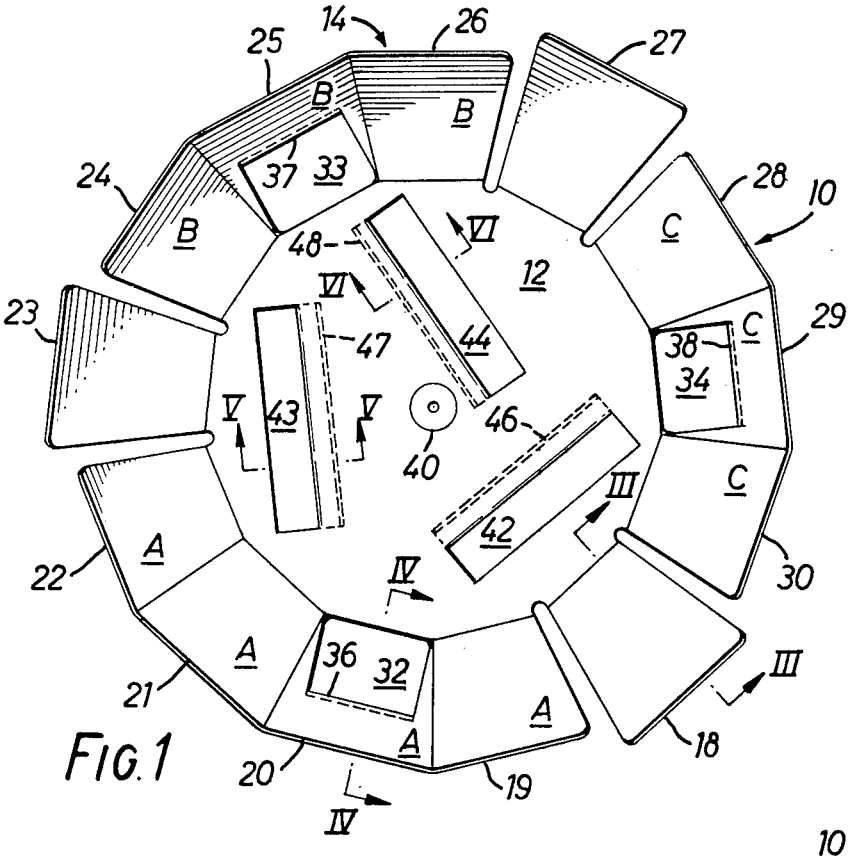
FIG. 1 is a plan view of a microwave oven field stirrer which embodies the invention.
Figure 2:
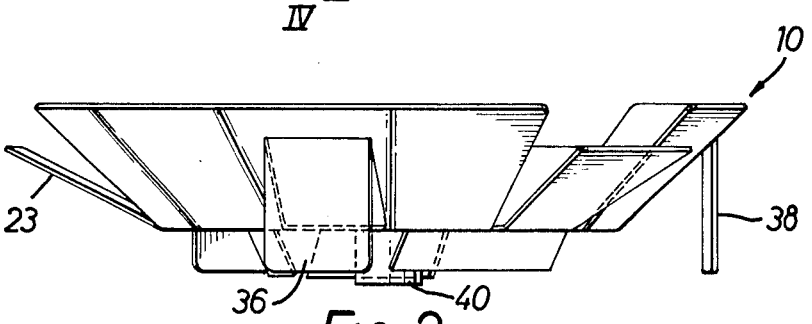
FIG. 2 is a side elevational view of the stirrer shown in FIG. 1.

Referring to the drawing, the illustrated field stirrer 10 is of the type shown in U.S. Pat. No. 3,872,276 and is intended for installation in a microwave oven in the same manner as shown in that patent.

The stirrer 10 has a generally upward concave pan shape and may be a sheet metal stamping made of aluminum having a thickness of approximately 0.040 inch. The illustrated field stirrer has a central planar section 12 and a surrounding section 14 which comprises a plurality of circumferentially arranged segments 18 to 30 having planar surfaces and being shaped like equilateral trapezoids. The surrounding section 14 has three circumferentially spaced segment groups A, B and C in which the individual segments thereof slope upwardly at an angle of approximately 45°relative to the planar section 12. Each of the segment groups A, B and C includes three or four segments which are laterally joined by folded edges. The full set of segments 18 to 30 includes three individually mounted segments 18, 23 and 27 arranged alternately relative to the three segment groups A, B and C and in circumferentially spaced relation thereto. The three segments 18, 23 and 27 slope upwardly at an angle of approximately 27° relative to the central planar section 12.

In effect the surrounding section 14 has a thirteen sided periphery which forms linear outer edges for the 13 segments 18 to 30. All of the segments are in bent relation to the periphery of the central section 12 with the individual bends forming linear inner edges for the segments 18 to 30.

The segments in each of the groups A, B and C are laterally joined to each other with radially extending linear sides being formed by bending.

Figure 3:
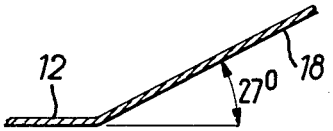
FIGS. 3 to 6 are fragmentary sectional elevational views taken respectively on lines III—III to VI—VI of FIG. 1.

The opposite, radially extending sides of each of the segments 18, 23 and 28 are separated from the adjacent segments of the groups A, B and C. As indicated with respect to segment 18 in FIG. 3, each of the segments 18, 23 and 27 form an angle of 27° relative to the central planar section 12.

At least one segment in each of the segment groups A, B and C has a rectangularly shaped opening with a rectangularly shaped flap extending vertically downwardly from the upper edge of the opening. These are illustrated as segments 20, 25 and 29 which are in circumferentially spaced relation and each is joined to segments on opposite sides thereof. Segments 20, 25 and 29 have, respectively, rectangularly shaped openings 32, 33 and 34 and generally vertically extending flaps 36, 37 and 38 which are hinged from the upper edges of the openings. The flaps are illustrated as being the same size as the openings and, if desired, the flaps can be provided by utilizing the metal cut from the segments to form the holes.

Figure 4:
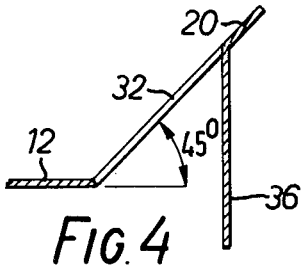

FIG. 4 shows the opening 32 and the flap 36 for the segment 20 and it will be understood that segments 25 and 29 have identical arrangements relative to openings and flaps.

The central planar section 12 has a centrally located hub member 40 which is attachable to a shaft (not shown) to facilitate rotating the field stirrer with an electric motor.

Three rectangularly shaped openings 42, 43 and 44 in planar section 12 are spaced from the hub member 40 and extend in generally tangential directions relative thereto. Openings 42, 43 and 44 are more or less randomly arranged and have flaps 46, 47 and 48 which are hinged from the inner edges of the openings. These flaps are inclined towards the hub member 40 to form acute angles relative to the central planar section 12. Flaps 46, 47 and 48 are illustrated as being the same size as the openings 42, 43 and 44 and, if desired, the flaps can be provided by utilizing the metal cut from the openings.

Figure 5:
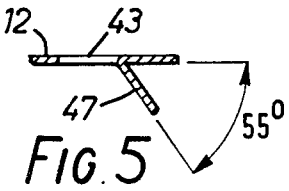
Figure 6:
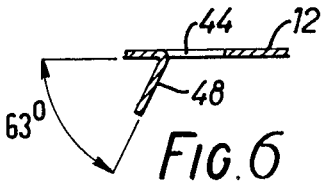

FIG. 5 shows the flap 47 as forming an acute angle of 55 degrees relative to central planar section 12 and FIG. 6 shows the flap 48 as forming an acute angle of 63° relative to the central planar section 12. Flap 46 may form an acute angle on the order of 45° relative to the central planar section 12.

The design of field stirrers is a largely empirical cut and try proposition to achieve the best results. Tests have shown that the particular reflecting characteristics of the field stirrer described above markedly improve the energy distribution patterns in the oven. An added feature is that the blade configuration causes a reduction in the microwave energy concentration in the vicinity of the oven door and this lessens the difficulty of providing effective microwave energy sealing means for the door.

I claim:

1. A field stirrer for a microwave oven, said stirrer being of the type having an upwardly concave pan shape and being formed as a sheet metal stamping, said stirrer comprising a central planar section and a surrounding section comprising a plurality of circumferentially arranged segments with planar surfaces and being shaped like equilateral trapezoids, said surrounding section having three circumferentially spaced segment groups in which the individual segments thereof slope upwardly at an angle of approximately 45° relative to said planar section, each of said segment groups including at least three of said segments which are laterally joined by folded edges and wherein at least one segment in each of said segment groups has a rectangularly shaped opening with a rectangularly shaped flap extending downwardly from the upper edge of said opening, said plurality of segments including three individually mounted segments arranged alternately relative to said three segment groups and in circumferentially spaced relation thereto, said three segments sloping upwardly at an angle of approximately 27° relative to said central planar section.

2. A field stirrer according to claim 1 including a central hub member attached to said central planar section, at least one rectangularly shaped opening in said planar section spaced from said hub member and extending in a generally tangential direction relative thereto, a rectangularly shaped flap attached to said central planar member at the inner edge of said opening, said planar section flap being inclined towards said hub member to form an acute angle relative to said central planar section.

3. A field stirrer according to claim 1 including a central hub member attached to said central planar section, at least three rectangularly shaped openings in said planar section spaced from said hub member and extending in a generally tangential direction relative thereto, rectangularly shaped flaps attached to said central planar member at the respective inner edges of said planar section openings, said planar section flaps being inclined towards said hub member to form acute angles relative to said central planar section.

* * * * *